US005707135A

United States Patent [19]

Miller, Jr.

[11] Patent Number: 5,707,135

[45] Date of Patent: Jan. 13, 1998

[54] UMBRELLA WITH FLASHLIGHT HANDLE

[76] Inventor: Moses Miller, Jr., 24763 Rensselaer, Oak Park, Mich. 48237

[21] Appl. No.: 710,479

[22] Filed: Sep. 18, 1996

Related U.S. Application Data

[60] Provisional application No. 60/003,910 Sep. 18, 1995.

[51] Int. Cl.[6] ..... A45B 3/02

[52] U.S. Cl. ..... 362/102; 362/208; 135/910

[58] Field of Search ..... 362/102, 191, 362/208; 135/16, 910

[56] References Cited

U.S. PATENT DOCUMENTS

| | | | |
|---|---|---|---|
| 1,128,167 | 2/1915 | Manson | 362/102 |
| 4,872,468 | 10/1989 | Cole | 135/910 |

FOREIGN PATENT DOCUMENTS

| | | | |
|---|---|---|---|
| 64739 | 4/1942 | Norway | 135/910 |
| 2224931 | 5/1990 | United Kingdom | 362/102 |

*Primary Examiner*—Y. My Quach
*Attorney, Agent, or Firm*—John R. Benefiel

[57] ABSTRACT

An umbrella in which a flashlight has a body adapted to have one end attached to the shaft of the umbrella to be used as a handle for the umbrella. The light bulb and reflector are mounted in the opposite end of the flashlight body, which is angled to make it easier to direct the beam. The flashlight body is sealed against the entrance of moisture. Each end cap has an O-ring seal and the switch is a deflectable rubber or plastic button. The batteries and switch are mounted to a removable cartridge or carrier piece which mates with the inside of the flashlight body so as to be able to be inserted in only one way insuring correct assembly. The end cap at the end of the flashlight body attached to the umbrella shaft has a tapered bore press fitted to the shaft.

2 Claims, 5 Drawing Sheets

UMBRELLA WITH FLASHLIGHT HANDLE

CROSS-REFERENCE TO RELATED APPLICATION

This application is base on provisional application U.S. Ser. No. 60/003,910, filed on Sep. 18, 1995.

BACKGROUND OF THE INVENTION

This invention concerns improvements to a flashlight handle for an umbrella. It has heretofore been proposed to provide an umbrella handle which also acts as a flashlight for convenient illumination on dark, rainy nights.

Prior designs have employed directly downwardly directed light at the handle end. This has the disadvantage of requiring that the umbrella top be completely swung away when attempting to illuminate an area forward of the user—exposing the user to rain.

U.S. Pat. No. 5,280,799 provides a sharply angled light at the top of the handle, which is less effective to illuminate the area directly beneath the umbrella.

Another problem has been secure mounting of the umbrella shaft to the flashlight, since buffeting winds can easily loosen the connection or damage the flashlight handle. If the shaft is extended completely within the handle, this requires an increased handle size to accommodate both the shaft and the batteries.

It is therefore an object of the present invention is to provide a light arrangement for umbrella handles which is more convenient to use.

Another object of the present invention is to provide an umbrella shaft-flashlight handle connection which is very sturdy, in which the shaft does not occupy a substantial portion of the inside volume of the flashlight handle.

SUMMARY OF THE INVENTION

These objects, which will become apparent upon a reading of the following specification and claims, are achieved by an umbrella handle which is configured with an angled bottom end which houses a light so as to effectively illuminate the area beneath the umbrella while allowing forward illumination without excessive tilting of the umbrella shaft, so as to continue to provide rain protection for the user.

The shaft is mounted in a tubular socket molded into an upper end cap threaded to a flashlight body. The socket is supported by a series of radial webs which intersect an inverted frusto-conical wall which extends from an outer cap rim into the socket at a point intermediate its length. The resulting structural support for the umbrella shaft is very strong, and the socket does not extend into the battery compartment of the flashlight handle main body member.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
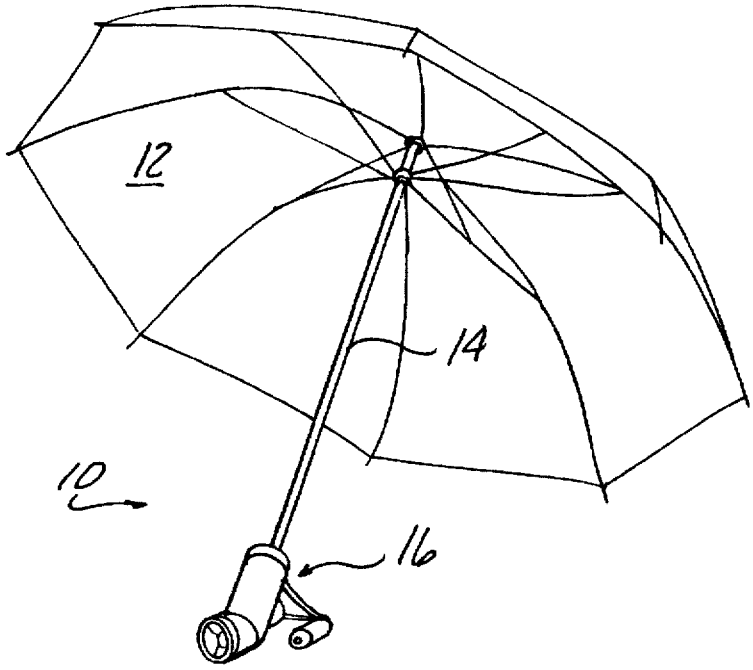
FIG. 1 is perspective view of an umbrella having a flashlight handle according to the present invention.

FIG. 1 shows an umbrella 10 having a collapsible top 12 at the upper end of the shaft 14, in conventional fashion.

A flashlight handle 16 is attached at the lower end of the shaft 14.

Figure 2:
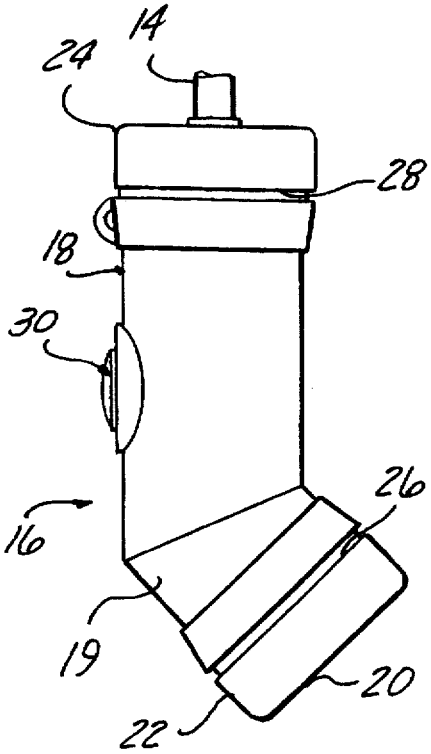
FIGS. 2 and 2A are enlarged front elevational views of the flashlight handle.

Referring to FIG. 2,, the flashlight handle 16 has a molded plastic hollow main body 18 which has an angled lower end 19, which has a light 20 aimed at an angle to the major axis of the main body 18 and the shaft 14 of the umbrella, which projects from the upper end of the main body.

A lower end cap 22 is threaded to the lower end 19 and an upper cap 24 is threaded to the upper end. Gaskets 26 and 28 seal the end caps 22, 24 to the main body 18.

A push switch cover 30 protrudes from the side of the main body 18.

Figure 3:
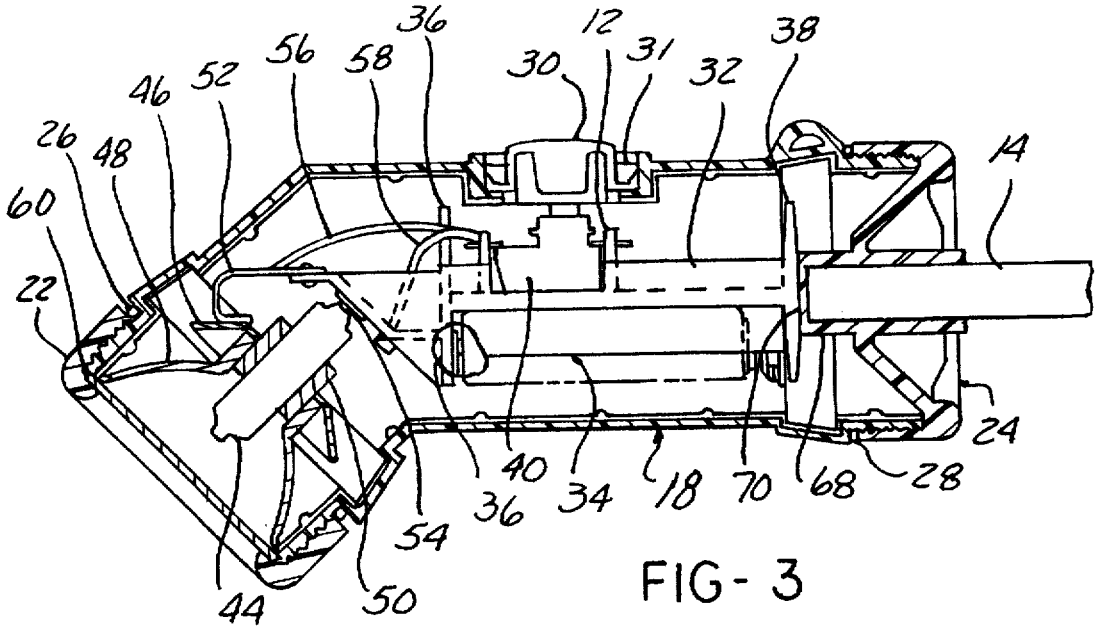
FIG. 3 is a lengthwise partially sectional view of the flashlight handle shown in FIG. 2.

FIG. 3 shows the interior functional components. A battery carriage 32 holds a pair of AA batteries 34 between a pair of end flanges 36, 38.

A push switch 40 is attached to one side and positioned below the switch cover 30 when the carriage 32 is slid into position inside the main body 18. One end of the carriage 32 abuts an end wall 70 of a tubular socket portion 68 of the upper end cap 24, while the other end abuts the base of a 3-volt light bulb 44.

Figure 7:
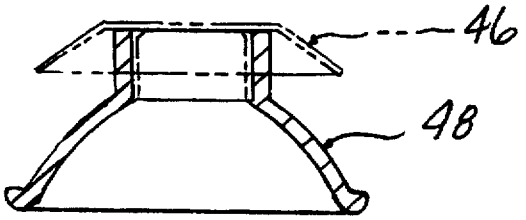
FIGS. 7 and 8 are enlarged sectional views of the tilt retainer and reflector.
Figure 8:
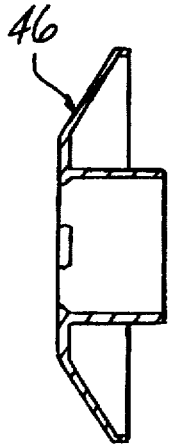
Figure 9:
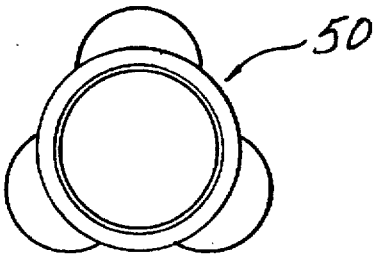
FIGS. 9 and 10 are views of a bulb holder.
Figure 10:
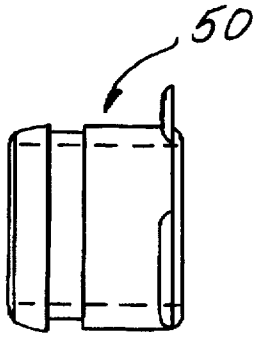

The flange of light bulb 44 is held against a cone-shaped metal tilt retainer 46 attached to a reflector 48 (FIGS. 7 and 8) by a bulb holder 50 (FIGS. 9 and 10) passed into the tilt retainer 46.

Suitable bulb contacts 52, 54 and leads 56, 58 to the switch 40 and battery ends allow the bulb to be selectively turned on and off by depression of the switch cover 30. Switch cover 30 is held by a ring 31.

A window cover 60 is held onto the reflector by the lower end cap 22.

Figure 2A:
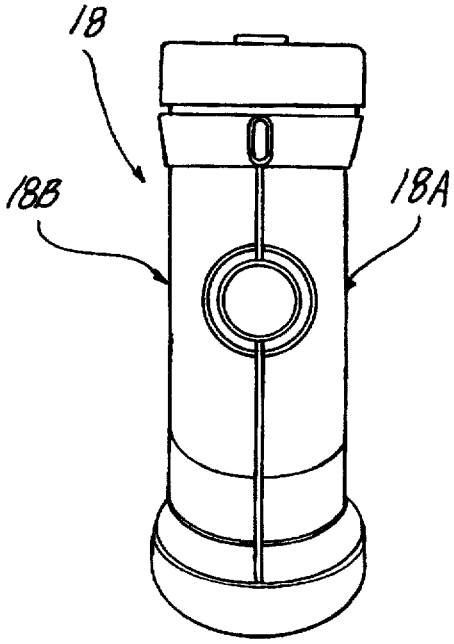
Figure 5:
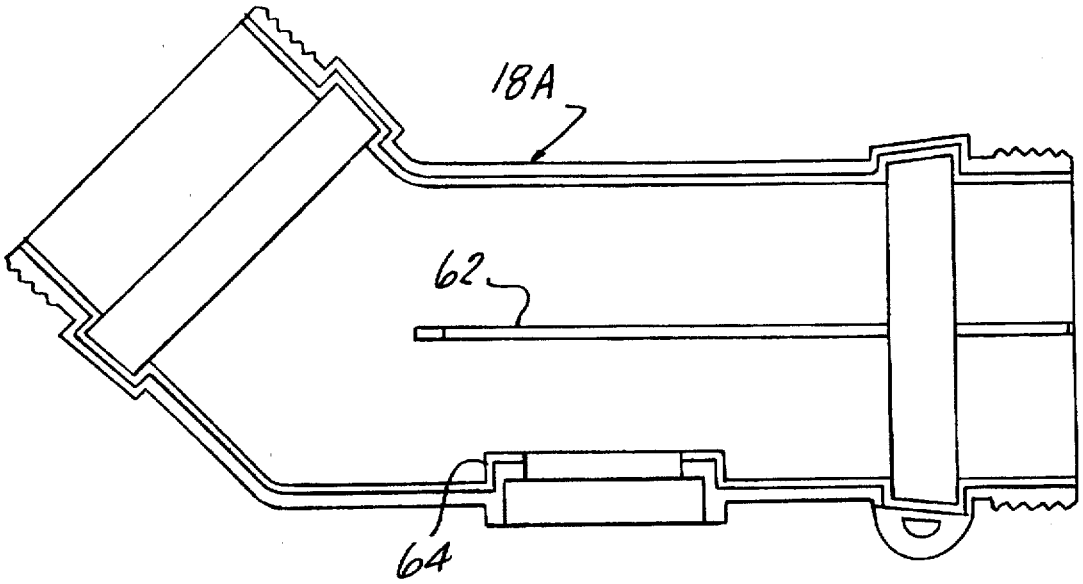
FIGS. 5 and 5A are enlarged views of the halves of the main body of the flashlight handle.
Figure 5A:
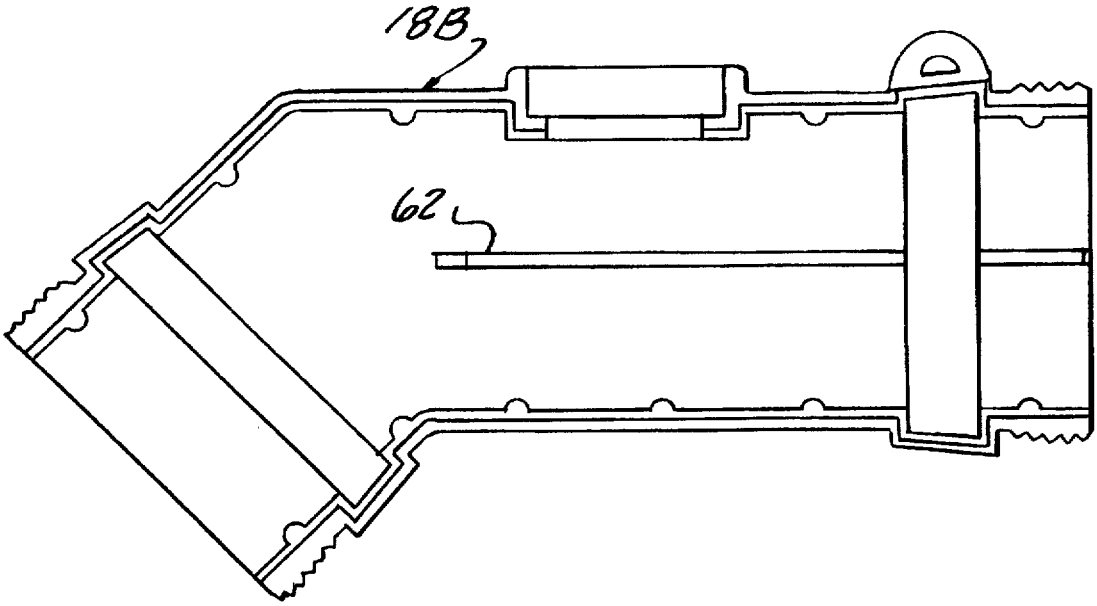

The main body 18 may be constructed of two molded halves 18A, 18B (FIG. 2A), sonic welded together, the interior left half 18A shown in FIG. 5.

Internal ribs 62 extend lengthwise down the inside of each half of housing 18.

Figure 6:
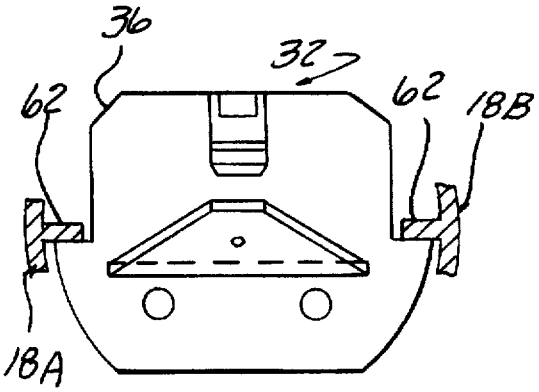
FIGS. 6–6F are enlarged views of the battery carriage included in the flashlight handle.
Figure 6A:
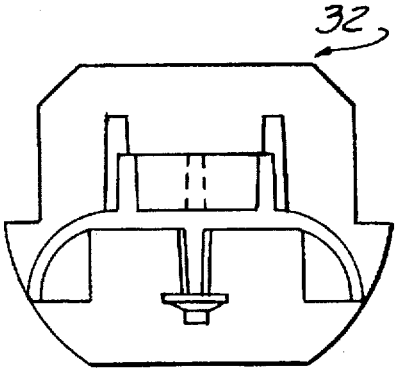
Figure 6B:
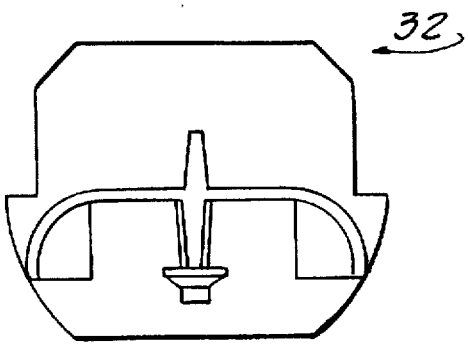
Figure 6C:
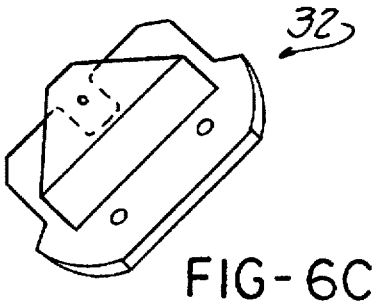
Figure 6D:
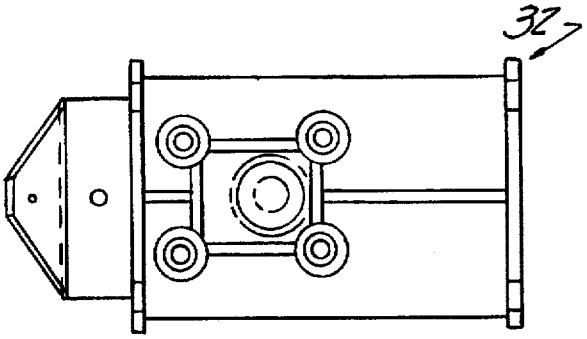
Figure 6E:
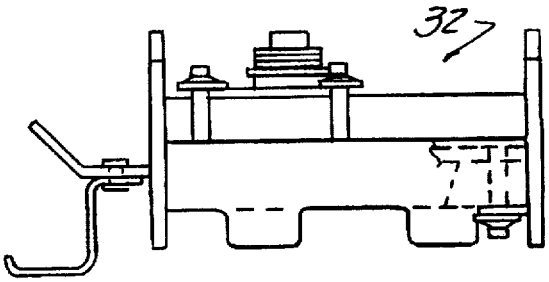
Figure 6F:
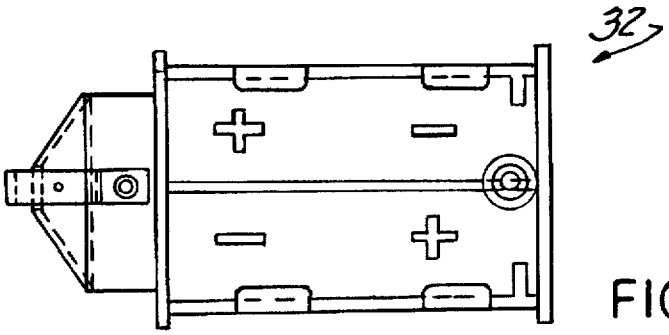

The flanges 36, 38 of the carriage 32 are notched as shown in FIG. 6 to fit beneath the ribs 62 and be held thereby. The carriage 32 cannot be inserted in an inverted position since interference will occur with a switch cover feature 64 protruding into the interior of the main body 18, for insuring proper assembly.

Figure 4:
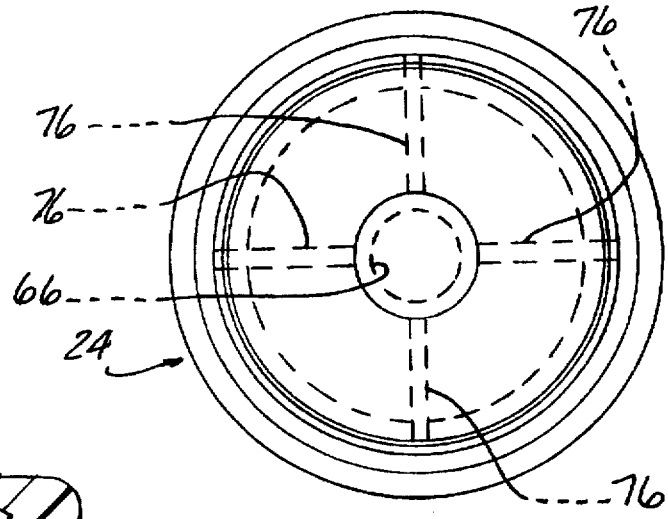
FIG. 4 is an enlarged endwise view of the upper end cap of the flashlight handle.
Figure 4A:
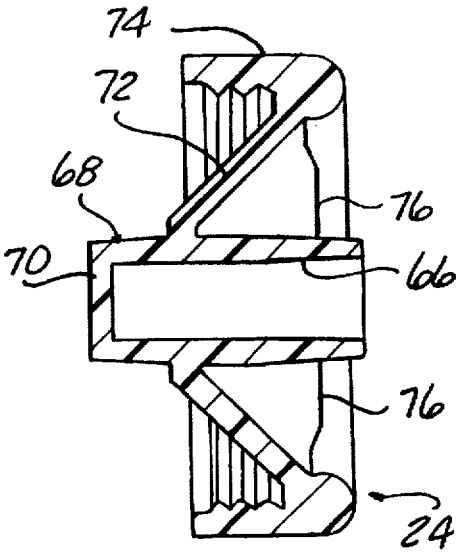
FIG. 4A is an enlarged sectional view of the end cap.

The umbrella shaft 14 is securely held in socket 66 formed by the inside of a tubular portion molded into the upper end cap 24 (FIGS. 4, 4A). An endwall 70 limits the distance the shaft 14 can enter the socket 66.

An inverted frusto-conical wall 72 extends radially outward from the tubular portion 68 to the threaded rim 74. A series of four radial stiffener ribs 76 are integrally formed and extend from the outside of portion 68 to the inside of the wall 72, creating a very strong structure for resisting side movements of the shaft 14.

The shaft 14 can be held therein with glue or other suitable fastener means.

I claim:

1. An umbrella having a collapsible top at an upper end of a shaft, said shaft also having a bottom end;

a flashlight handle attached to the said bottom end of the shaft;

said flashlight handle having a graspable main body angled at a lower end, said main body having an upper end cap formed with a socket receiving said umbrella shaft bottom end, said socket comprising a tubular portion integrally secured to a rim of said end cap with an intervening frusto-conical wall;

a light bulb and a reflector mounted in said angled lower end of said main body;

a battery compartment in said main body adapted to receive a set of batteries;

a power supply circuit interconnecting said batteries and light bulb;

a switch operable to control powering of said light bulb by said batteries received in said battery compartment;

whereby said light bulb when energized projects light from said angled lower end of said flashlight handle.

2. The umbrella according to claim 1 further including a series of radial ribs extending between an outside of said tubular portion and an inside surface of said frusto-conical wall.

* * * * *